US008545188B2

(12) United States Patent
Infanger

(10) Patent No.: US 8,545,188 B2
(45) Date of Patent: Oct. 1, 2013

(54) CONTROLLER AND THE USE THEREOF

(75) Inventor: Stefan Infanger, Neustift (AT)

(73) Assignee: Weber Hydraulik GmbH, Losenstein (AT)

( * ) Notice: Subject to any disclaimer, the term of this patent is extended or adjusted under 35 U.S.C. 154(b) by 398 days.

(21) Appl. No.: 12/866,675

(22) PCT Filed: Jan. 25, 2009

(86) PCT No.: PCT/EP2009/000463

§ 371 (c)(1),
(2), (4) Date: Aug. 6, 2010

(87) PCT Pub. No.: WO2009/112121

PCT Pub. Date: Sep. 17, 2009

(65) Prior Publication Data

US 2011/0008187 A1 Jan. 13, 2011

(30) Foreign Application Priority Data

Mar. 12, 2008 (DE) ..... 10 2008 013 849

(51) Int. Cl.
*F04B 49/00* (2006.01)

(52) U.S. Cl.
USPC ..... 417/34; 60/431; 251/62; 251/294; 123/198 C

(58) Field of Classification Search
USPC ..... 417/34; 60/431; 91/513, 530, 47; 251/62, 294; 123/198 C; 74/579 R, 580, 74/581, 582, 583, 584
See application file for complete search history.

(56) References Cited

U.S. PATENT DOCUMENTS

| | | | | | |
|---|---|---|---|---|---|
| 2,126,863 | A | * | 8/1938 | Barton | 251/58 |
| 2,690,712 | A | * | 10/1954 | Foote | 417/34 |
| 2,931,305 | A | * | 4/1960 | Stratton | 417/34 |
| 3,152,445 | A | | 10/1964 | Weisenbach | |
| 3,284,999 | A | * | 11/1966 | Lease | 60/431 |
| 3,444,689 | A | * | 5/1969 | Budzich | 60/427 |
| 3,459,131 | A | * | 8/1969 | Senf | 417/34 |
| 3,473,321 | A | * | 10/1969 | Huggins | 60/399 |

(Continued)

FOREIGN PATENT DOCUMENTS

| | | |
|---|---|---|
| DE | 848 108 | 4/1942 |
| DE | 1 1129 343 | 5/1962 |

(Continued)

OTHER PUBLICATIONS

International Search Report dated Apr. 17, 2009 (Three (3) pages).

(Continued)

*Primary Examiner* — Devon Kramer
*Assistant Examiner* — Joseph Herrmann
(74) *Attorney, Agent, or Firm* — Crowell & Moring LLP

(57) ABSTRACT

A hydraulic controller having at least one input for a hydraulic fluid for controlling the speed of a hydraulic pump driven by an internal combustion engine is characterized in that the controller has at least two inputs, that at least two pressure chambers each connected to one of the inputs are provided, that each of the same has a piston displaceable under pressure from a rest position against the force of a spring into a switched position and that the piston rod thereof engages at the end of a rod or a pull in the switched position.

12 Claims, 2 Drawing Sheets

(56) References Cited

U.S. PATENT DOCUMENTS

| | | | | |
|---|---|---|---|---|
| 3,640,253 | A * | 2/1972 | Glover et al. | 123/392 |
| 3,797,967 | A * | 3/1974 | Howeth | 417/34 |
| 3,888,083 | A * | 6/1975 | Tone | 60/431 |
| 4,024,711 | A | 5/1977 | Russell, Jr. | |
| 4,986,783 | A * | 1/1991 | Brown | 440/89 R |
| 5,678,982 | A | 10/1997 | Schwaiger | |
| 2011/0008187 | A1 | 1/2011 | Infanger | |

FOREIGN PATENT DOCUMENTS

| | | | |
|---|---|---|---|
| DE | 1 216 067 | | 5/1966 |
| DE | 1 425 821 | | 7/1970 |
| DE | 28 56 805 | A1 | 7/1980 |
| DE | 36 09 399 | A1 | 10/1986 |
| DE | G 94 12 147.8 | | 7/1994 |
| DE | 94 12 147.8 | U1 | 11/1994 |
| EP | 2 260 210 131 | | 1/2009 |
| GB | 1 439 193 | | 6/1976 |
| GB | 2 118 241 | A | 10/1983 |
| JP | 2-12036 | U | 1/1990 |

OTHER PUBLICATIONS

German Search Report mailed Aug. 18, 2009.

* cited by examiner

CONTROLLER AND THE USE THEREOF

FIELD OF THE INVENTION

The invention relates to a generic hydraulic controller having at least one input for a hydraulic fluid for controlling the speed of a hydraulic pump driven by an internal combustion engine, and the use of the controller.

BACKGROUND OF THE INVENTION

Today, hydraulic systems are applied in multiple ways for providing large forces, for example for operating tools. Particularly tools in rescue and salvage technology, such as spreaders, presses or shears, also require the mobility of such hydraulic systems. As normally there is no power supply available at these various and undefined sites of operation, the mechanical drive of the pumps of the hydraulic systems also has to be performed by mobile drives, such as, for example, by internal combustion engines or battery-driven electric motors (DE-9412147-U).

However, especially in the case of mobile systems, high energy efficiency may be important because owing to circumstances the energy carriers used may be available only in a highly restricted manner at the site of operation. Further, when assembling the hydraulic systems and/or connecting the respective hydraulic tools to the hydraulic system, an assembly or connection as quick and simple as possible is often desired because every additionally required hand movement takes time and/or harbors other sources of errors. In rescue service in particular, there is often no time or capacity to provide for an especially efficient or low-emission operation of the rescue device. In addition, the hydraulic pump is controlled by the connected hydraulic tool in a sense that upon its actuation, the drive is raised from idle running to higher speeds.

In the prior art, this is caused by an electric switch provided on the tool (DE-9412147-U) that, however, has to be connected to the motor via a separate electric line which, however, is not desired.

In the prior art, a hydraulic controller having at least one input for a hydraulic fluid for controlling the speed of a hydraulic pump driven by an internal combustion engine has also been previously used in which the deflection of a piston, which is floatingly supported to some extent, effected by the flow of the hydraulic fluid is obtained by an electric proximity switch whereby an electric signal is output to the drive control. Thus, the speed of the internal combustion engine is changed by means of an electric servo motor via a carburetor provided on the former. Neither the failure-prone proximity switch nor the additional servo motor on the carburetor are particularly preferred in rescue because they make the devices unnecessarily complicated and are not always sufficiently robust for the tough use in emergencies.

Furthermore, the mobile hydraulic aggregates usually have at least two mutually independent hydraulic circuits. If all of these hydraulic circuits are also to be driven, at least two further disclosed controllers are required which is even less desirable.

SUMMARY OF THE INVENTION

Therefore, it is the object of the invention to provide an enhanced controller particularly suited for the operation of such pumps that have at least two mutually independent hydraulic circuits.

According to the invention, this object is achieved in a generic hydraulic controller having at least one input for a hydraulic fluid for controlling the speed of a hydraulic pump driven by an internal combustion engine by the fact that the controller has at least two inputs, that at least two pressure chambers each connected to one of the inputs are provided, that each of the same has a piston displaceable under pressure from a rest position (FIG. 4, bottom) against the force of a spring into a switched position (FIG. 4, top) and that the piston rod thereof engages at the end of a rod or a pull in the switched position and operates the same, as well as the use of a controller according to the invention between the tank taking up the hydraulic fluid and the hydraulic pump driven by the drive, the at least two pressure sides of which can be connected via the at least two flows in the form of hydraulic conduits to the at least two hydraulic tools operable via the hand switches of the valves.

When the pistons are in the rest position, the end of the connected rod or pull makes the internal combustion engine run idle. If due to the operation of one of the at least two or of two connected tools the pressure of the hydraulic fluid increases, the one or both pistons are moved from the rest position into the switched position. Consequently, the end of the piston or the pull is also moved and effects the increase to the maximum speed of the internal combustion engine from the idling cycle thereof and thus also for a higher power output of the hydraulic pump driven by this internal combustion engine. In a manner of speaking, the hydraulics is speeded up without the need of a separate, for example electric, line from the tool to the internal combustion engine. When the tool is no longer operated, the pressure drops and the piston is returned to its rest position while at the same time the end of the rod or pull is moved back whereby the internal combustion engine is returned to the idling cycle.

Thus, according to the teaching of the invention, it is advantageously possible in any case to control two tools simultaneously connected to correspondingly adapted pumps by a single inventive controller; it works like an OR element having a mechanical output, which element is fluidically driven at the input side.

Suitably, the hydraulic pump, the intake side and pressure side of which are connected to each other via a return or flow in the form of hydraulic conduits, can be connected to a hydraulic tool operable via a hand switch of a valve, which valve preferably has a switching position connecting the flow to the return wherein the hydraulic pump driven by the drive circulates the hydraulic fluid in the idling cycle of the drive from the intake side to the pressure side to that of the pump.

The controller is particularly easily designed if the pull of the controller is formed as a Bowden cable and if a drive control connected to the end of the rod or the pull is provided for the drive advantageously formed as a carburetor of the internal combustion engine.

Further advantageous embodiments and developments of the invention are described hereinafter.

BRIEF DESCRIPTION OF THE DRAWINGS

Preferred embodiments of the invention will be explained in more detail below with reference to the drawings, wherein.

DETAILED DESCRIPTION OF PREFERRED EMBODIMENTS

Figure 1:
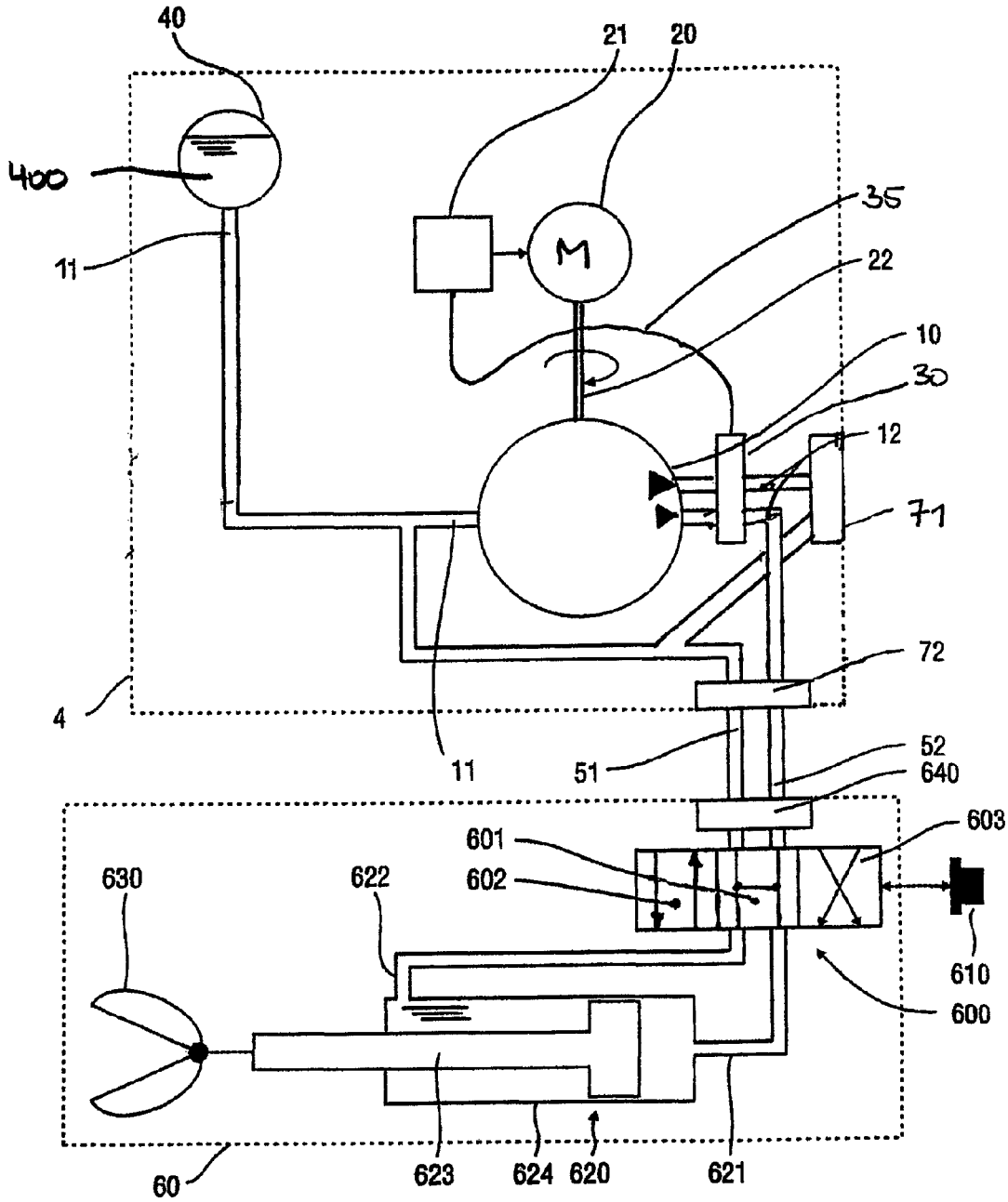
FIG. 1 shows a controller in a schematically wired illustration.

FIG. 1 shows a schematic illustration of a hydraulic system of the present invention. Accordingly, a hydraulic system 4 comprises a pump 10, a mechanical drive 20, a controller 30 and a tank 40 which provides or can take up hydraulic fluid 400, such as, for example, hydraulic oil. Furthermore, a hydraulic tool 60 can be connected to the hydraulic system 4 which here is exemplarily shown as a hand tool in the form of a hydraulic cutting tool.

In this case, a controller 30 for measuring the pressure of the hydraulic fluid 400 is inserted in each of the at least two pressure-side terminals 12 of the pump 10. The hydraulic pump, the intake side 11 and pressure side 12 of which are connected via a return 51 or flow 52 in the form of hydraulic conduits to the hydraulic tool 12 operable via a hand switch 610 of a valve 600, is disposed between the controller 30 and the tank 40 taking up the hydraulic fluid and driven by the drive 20 designed as an internal combustion engine M.

Furthermore, the controller 30 is connected to a drive control 21 designed as a carburetor via a Bowden cable 35 whereby it is possible to control the speed of the drive 20. The drive 20 provides a mechanical drive performance to the pump 10 by means of a power transmission 22, such as, for example, a shaft. The drive control 21 adjusts the driving performance of the drive 20 in a manner controlled by the controller 30.

The valve 600 has a switching position 601 connecting the flow 52 to the return 51 in which the hydraulic pump 10 driven by the drive 20 circulates the hydraulic fluid in the idling cycle of the drive from the intake side 11 to the pressure side 12 into the housing of the pump 10. The tool 60 is provided with a doubly acting piston/cylinder arrangement 620 comprising a proper piston 624 and a piston having a piston rod 623 as well as a cutting tool 630. The pressure side 12 of the pump 10 is connected to the hydraulic tool 60 via the flow 52, and the intake side 11 of the pump is connected to the hydraulic tool via the return 51. Detachable couplings 71, 72 and 640 may be provided on the side of the hydraulic system 4 and/or on the side of the hydraulic tool 60 in order to enable a tool change.

The valve 600, which can be adjusted via a mechanical, manual or electrical actuator 610 from outside, furthermore has a first valve position 601, a second valve position 602 and a third valve position 603. In the second valve position 602, the valve 600 connects the flow 52 and thus the pressure side 12 of the pump 10 via the conduit 621 to the cylinder chamber, and connects the return 51 and thus the intake side 11 of the pump to the piston rod chamber via the conduit 622. In this condition, the pump 10 delivers hydraulic fluid 400 to the cylinder chamber whereby the piston rod 623 is extended and the tool 60 correspondingly operated.

In the third valve position 603, the valve 600 connects the flow 52 and thus the pressure side 12 of the pump 10 to the piston rod chamber via the conduit 622, and connects the return 51 and thus the intake side 11 of the pump to the cylinder chamber via the conduit 621. In this condition, the pump 10 delivers hydraulic fluid 400 to the piston rod chamber, whereby the hydraulic tool 60 is moved in a reverse direction.

Both in the second and the third valve position 602 and 603, respectively, the hydraulic fluid 400 is supplementarily delivered from the tank 40. This means that during the operation of the hydraulic tool 60 or while the hydraulic tool 60 performs work, the speed of the drive 20 is advantageously increased automatically to maximum speed via the position switch and the drive control 21 in comparison to the idle speed.

Furthermore, in the first valve position 601 the valve 600 connects the flow 52 to the return 51 and thus enables a circulation of the hydraulic fluid 400.

Figure 3:
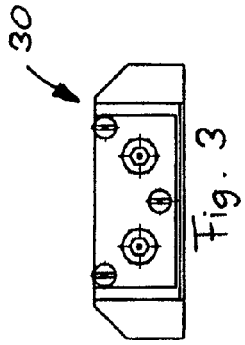
FIG. 3 shows a front view of the controller according to FIG. 1.
Figure 2:
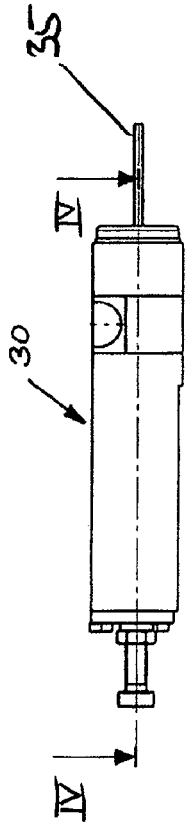
FIG. 2 shows a side view of the controller according to FIG. 1.
Figure 4:
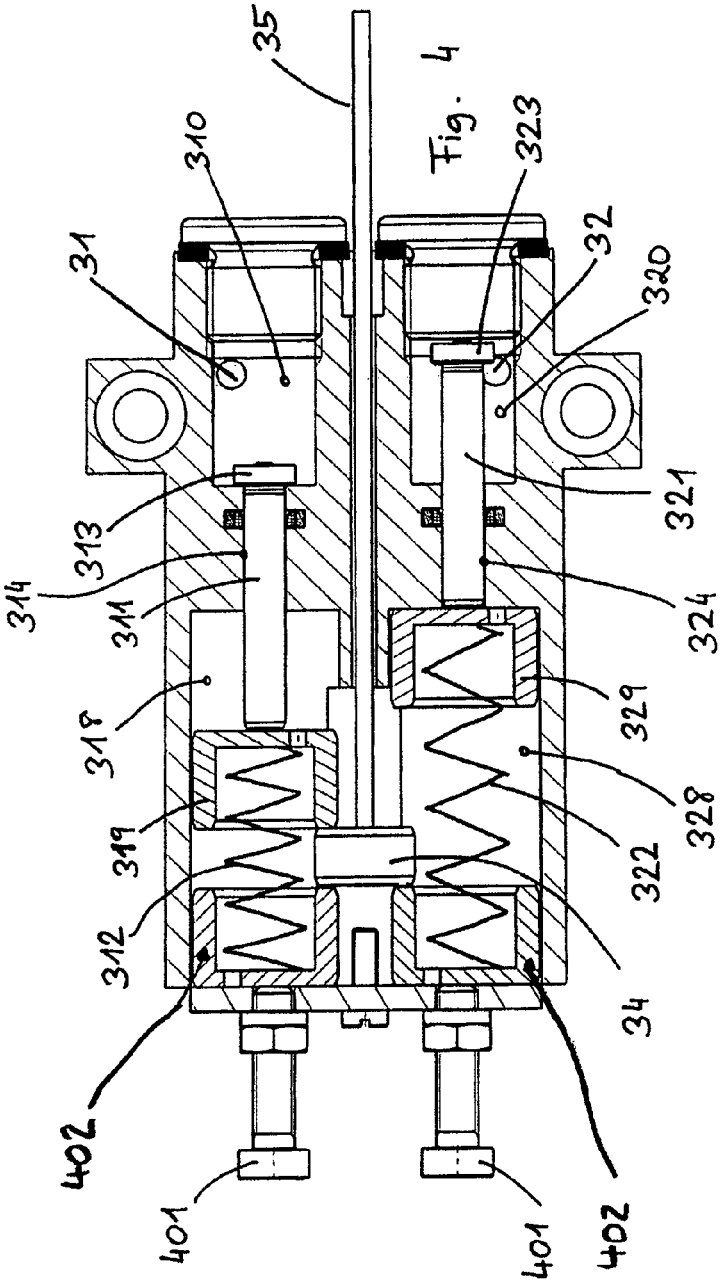
FIG. 4 shows a section IV-IV according to FIG. 2 at a larger scale.

The proper controller 30 is illustrated in more detail in FIGS. 2 to 4. In the embodiment as shown, it has two inputs 31, 32 (FIG. 4). Each of these inputs is connected to exactly one pressure chamber 310, 320 and each of the same is provided with a piston 313, 323 comprising a piston rod 311, 321, which piston under pressure can be displaced from a rest position (FIG. 4, bottom) against the force of a spring 312, 322 to a switched position (FIG. 4, top). In the switched position, the piston rod 311, 321 indirectly engages at the end 34 of a rod or a pull 35 and operates the same, which will be described in detail later. In the pressure chamber 310, 320, a piston rod guide 314, 324 is provided which guides the piston rod 311, 321 from its rest position to the switched position.

If the pistons 313, 323 are in the rest position, the end 34 of the connected Bowden cable 35 makes the internal combustion engine M run idle. If due to the operation of one of the two connected tools 60 the pressure of the hydraulic fluid 400 increases, the one piston 313 of the two pistons 313, 323 is displaced from the rest position (FIG. 4, bottom) to the switched position (FIG. 4, top). Consequently, the end 34 of the Bowden cable 35 is also displaced and makes the idle speed rise to the maximum speed of the internal combustion engine M and thus also causes a higher performance output of the hydraulic pump 10 moved by the same. If the tool is no longer operated, the pressure drops and the piston 313 returns to its rest position while the end 34 of the Bowden cable is simultaneously moved back whereby the internal combustion engine M returns to the idling cycle.

The piston rods 311, 321 of the controller 30 extend into a separate cylinder-shaped chamber 318, 328 delimited by the pressure chamber 310, 320 and accommodating the springs 312, 322 and abut the rear bottom of a cup-shaped piston 319, 329. One end of the spring 312, 322 abuts the base of the cup-shaped piston 391, 329 opposite this rear bottom.

In this case in the controller 30, the end 34 of the Bowden cable 34 extends into the movement path of each cup-shaped piston 319, 329 and is displaced by the latter when it moves in the switched position parallel thereto in the sense of an operation of the carburetor 21 as drive control of the internal combustion engine M or 20, whereby the latter is raised from idle speed to its maximum speed. Thus, the piston rod 311, 321 in the switched position indirectly engages at the end 34 of the rod or the pull 35 via the cup-shaped piston 319, 329 and operates the same and thus the carburetor as drive control 21 of the internal combustion engine.

For the purpose of adjustment, the other end of the spring 312, 322 is supported in likewise cup-shaped piston 402 which can be adjusted from outside via an adjusting screw 401. In this manner it is possible to adjust the initial tension of the spring as well as the adjustment range of the Bowden cable and thus the drive control.

The invention claimed is:

1. A hydraulic controller having at least two inputs for a hydraulic fluid for controlling a speed of a hydraulic pump driven by an internal combustion engine, comprising:

at least two pressure chambers, wherein each of said at least two pressure chambers is connected to a respective one of the at least two inputs;

a piston with a piston rod in each of said at least two pressure chambers, each said piston being displaceable under pressure from a rest position against a force of a spring into a switched position, wherein each said piston rod extends into a separate chamber, said separate chamber being delimited from the respective pressure chamber and accommodating said spring, and said piston rod abuts a rear bottom of a cup-shaped piston, releasably engages at an end of a common rod or a common pull in the switched position via said cup-shaped piston and is arranged to actuate the common rod or the common pull.

2. The controller according to claim 1, wherein a piston rod guide is provided for each said piston rod leading each said piston rod from the rest position to the switched position.

3. The controller according to claim 2, wherein each said piston has a larger diameter than the respective piston rod guide.

4. The controller according to claim 1, wherein the spring abuts a base of the cup-shaped piston opposite said rear bottom.

5. The controller according to claim 1, wherein the piston rod releasably engages at an end of the common pull, and the common pull is formed as a drawing wire or synthetic rope.

6. The controller according to claim 5, wherein the common pull formed as a drawing wire is formed as a Bowden cable.

7. The controller according to claim 1, wherein the end of said common rod or common pull extends into a movement path of each said cup-shaped piston and is displaceable in parallel thereto by said cup-shaped piston when said cup-shaped piston moves into the switched position.

8. The controller according to claim 7, wherein the hydraulic pump has an intake side and a pressure side which are connected via a return flow path in the form of hydraulic conduits, and the pump is connectable to a hydraulic tool operable via a hand switch of a valve.

9. The controller according to claim 8, wherein said valve has a switching position connecting the pressure side to the intake side of the hydraulic pump driven to recirculate the hydraulic fluid from the intake side to the pressure side of the hydraulic pump when the engine runs idle.

10. The controller according to claim 1, wherein a drive control is provided for the engine, which is connected to the end of the common rod or the common pull.

11. The controller according to claim 10, wherein the drive control is formed as a carburetor of the internal combustion engine.

12. A method of controlling a speed of a hydraulic pump driven by an internal combustion engine and having two pressure sides for respective hydraulic circuits and a controller having at least two inputs is arranged between the hydraulic pump and a tank for taking up a hydraulic fluid, said controller comprising at least two pressure chambers each connected to a respective one of the at least two inputs, each of the chambers having a piston with a piston rod, where said piston is displaceable under pressure against a force of a spring from a rest position into a switched position, the piston rod of each said piston releasably engaging an end of a common rod or a common pull in the switched position to actuate the common rod or the common pull, and each of the at least two pressure sides of the pump being connectable via at least two flow paths in the form of hydraulic conduits to a respective one of at least two hydraulic tools in response to operation of a hand switch of respective tool control valves, comprising the steps of:

driving the hydraulic pump with the internal combustion engine;

actuating said hand switch to direct the hydraulic fluid to the respective one of said at least two hydraulic tools;

moving said piston associated with said respective one of said two hydraulic tools from a resting position to a switched position to drive said common rod or common pull to increase a speed of the internal combustion engine.

* * * * *